US011540051B2

(12) United States Patent
Tu et al.

(10) Patent No.: US 11,540,051 B2
(45) Date of Patent: Dec. 27, 2022

(54) TWO-CHANNEL BALANCE METHOD AND ELECTRONIC DEVICE USING THE SAME

(71) Applicant: Acer Incorporated, New Taipei (TW)

(72) Inventors: Po-Jen Tu, New Taipei (TW); Jia-Ren Chang, New Taipei (TW); Kai-Meng Tzeng, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 17/237,395

(22) Filed: Apr. 22, 2021

(65) Prior Publication Data

US 2021/0337311 A1 Oct. 28, 2021

(30) Foreign Application Priority Data

Apr. 27, 2020 (TW) ..... 109114061

(51) Int. Cl.
*H04R 3/12* (2006.01)
*H04R 1/22* (2006.01)

(52) U.S. Cl.
CPC ..... *H04R 3/12* (2013.01); *H04R 1/22* (2013.01)

(58) Field of Classification Search
CPC ... H04R 3/12; H04R 1/22; H04R 3/14; H04R 1/20; H04R 1/24; H04R 3/04
USPC ..... 381/97–99, 103
See application file for complete search history.

(56) References Cited

U.S. PATENT DOCUMENTS 5,185,801 A * 2/1993 Meyer ..... H04R 3/04 381/59
5,537,479 A * 7/1996 Kreisel ..... H04R 1/02 381/89
9,119,012 B2 * 8/2015 Ikizyan ..... H04R 3/00
10,893,363 B2 * 1/2021 Choisel ..... H04R 29/002
2004/0202332 A1 10/2004 Murohashi et al.
2006/0050896 A1 3/2006 Sung
2008/0019533 A1 * 1/2008 Noguchi ..... H04S 5/00 381/17

(Continued)

FOREIGN PATENT DOCUMENTS

CN 101511047 A 8/2009
CN 101529930 A 9/2009

(Continued)

OTHER PUBLICATIONS

Taiwanese Office Action and Search Report for Taiwanese Application No. 109114061, dated Jul. 7, 2021.

*Primary Examiner* — Disler Paul
(74) *Attorney, Agent, or Firm* — Birch, Stewart, Kolasch & Birch, LLP

(57) ABSTRACT

A two-channel balance method and an electronic device using the same are provided. The two-channel balance method includes the following steps. A gain-frequency information of a two-channel signal is adjusted. A sampling delay information of the two-channel signal is calculated according to a distance information among a sound receiving unit, a left speaker unit and a right speaker unit. A forward test audio file or a surround test audio file is generated according to the sampling delay information. A phase offset information is estimated according to at least the forward test audio file or the surround test audio file. A phase offset direction information is determined. A phase information of the two-channel signal is adjusted according to the phase offset information and the phase offset direction information.

20 Claims, 5 Drawing Sheets

(56) References Cited

U.S. PATENT DOCUMENTS

| | | | |
|---|---|---|---|
| 2008/0212786 | A1 | 9/2008 | Park |
| 2009/0232318 | A1 | 9/2009 | Ohta |

FOREIGN PATENT DOCUMENTS

| | | | |
|---|---|---|---|
| CN | 102124672 | A | 7/2011 |
| CN | 102792712 | A | 11/2012 |

* cited by examiner

TWO-CHANNEL BALANCE METHOD AND ELECTRONIC DEVICE USING THE SAME

This application claims the benefit of Taiwan application Serial No. 109114061, filed Apr. 27, 2020, the subject matter of which is incorporated herein by reference.

BACKGROUND OF THE INVENTION

Field of the Invention

The invention relates in general to a two-channel balance method and an electronic device using the same, and more particularly to a two-channel balance method with phase offset correction and an electronic device using the same.

Description of the Related Art

Although the sound holes of speaker units are symmetrically arranged on the two-channel electronic device, the left channel signal and the right channel signal still may produce different frequency responses due to the difference in the design of the speaker unit and the internal mechanism of the two-channel electronic device. Through gain-frequency adjustment, the two-channel can be balanced by an equalizer (EQ) and the signals received by the sound receivers will have similar intensities.

When the user is physically in front of the electronic device, the user still may perceive offset in the sound field. Therefore, based on actual situations, phase adjustment also needs to be performed in addition to gain-frequency adjustment. However, since the electric system of the electronic device is very complicated, and the use time of electronic elements generate different influence on the phase during the assembly of each electronic device, it is very difficult to assign fixed parameters to phase adjustment.

SUMMARY OF THE INVENTION

The present invention relates to a two-channel balance method and an electronic device capable of resolving sound field offset through phase offset correction.

According to one embodiment of the present invention, a two-channel balance method with phase offset correction is provided. The two-channel balance method includes the following steps. A gain-frequency information of a two-channel signal is adjusted. A sampling delay information of the two-channel signal is calculated according to a distance information among a sound receiving unit, a left speaker unit and a right speaker unit. A forward test audio file or a surround test audio file is generated according to the sampling delay information. A phase offset information is estimated according to at least the forward test audio file or the surround test audio file. A phase offset direction information is determined. A phase information of the two-channel signal is adjusted according to the phase offset information and the phase offset direction information.

According to another embodiment of the present invention, an electronic device is provided. The electronic device includes a sound receiving unit, a left speaker unit, a right speaker unit, a gain-frequency adjustment unit, a delay calculation unit, an audio file generation unit, a phase offset estimation unit, a phase offset direction determination unit and a phase adjustment unit. The gain-frequency adjustment unit adjusts a gain-frequency information of a two-channel signal. The delay calculation unit calculates a sampling delay information of the two-channel signal according to a distance information among the sound receiving unit, the left speaker unit and the right speaker unit. The audio file generation unit generates a forward test audio file or a surround test audio file according to the sampling delay information. The phase offset estimation unit estimates a phase offset information according to at least the forward test audio file or the surround test audio file. The phase offset direction determination unit determines a phase offset direction information. The phase adjustment unit adjusts a phase information of the two-channel signal according to the phase offset information and the phase offset direction information.

According to an alternate embodiment of the present invention, an electronic device is provided. The electronic device includes a gain-frequency adjustment unit, a phase adjustment unit, a left speaker unit and a right speaker unit. The gain-frequency adjustment unit adjust a gain-frequency information of a two-channel signal. The phase adjustment unit adjusts a phase information of the two-channel signal according to a phase offset information and a phase offset direction information. The left speaker unit and the right speaker unit are configured to play the two-channel signal which is adjusted.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
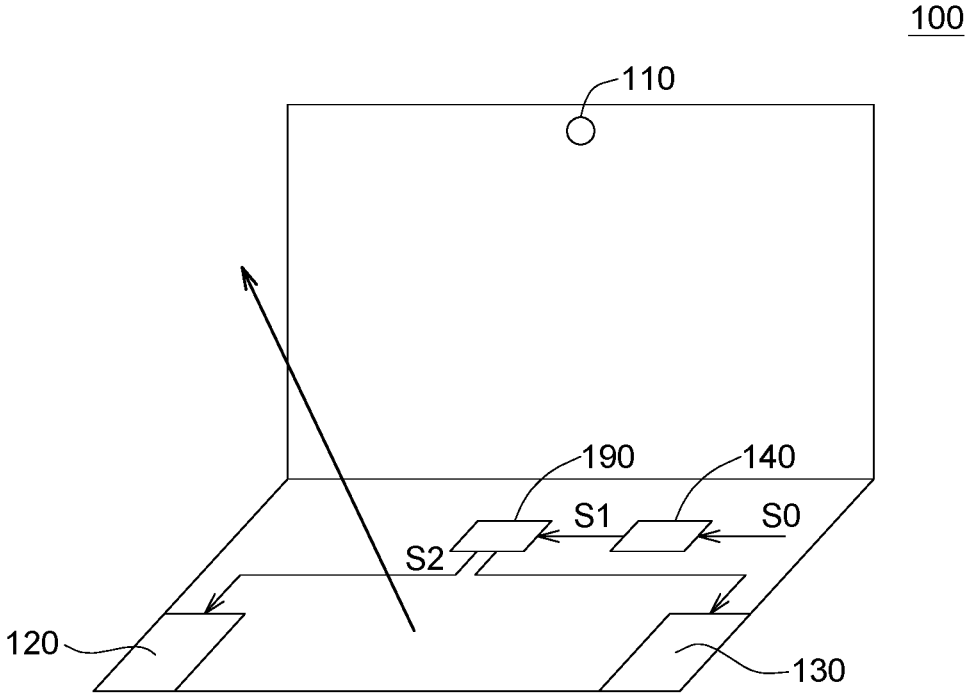
FIG. 1 is a schematic diagram of an electronic device according to an embodiment of the present invention.

Referring to FIG. 1, a schematic diagram of an electronic device 100 according to an embodiment of the present invention is shown. The electronic device 100 can be realized by a notebook, a PC tablet or a smart phone. The sound receiving unit 110 of the electronic device 100 can be realized by a microphone located above the screen. The electronic device 100 has a left speaker unit 120 which can be realized by a speaker located at the left of the device. The electronic device 100 has a right speaker unit 130, which can be realized by a speaker located at the right of the device. After the two-channel sound is balanced by an equalizer (EQ) through gain-frequency adjustment, the sound field perceived by the user still can be offset. In the present embodiment, the problem of sound field offset is resolved through phase offset correction.

Figure 2:
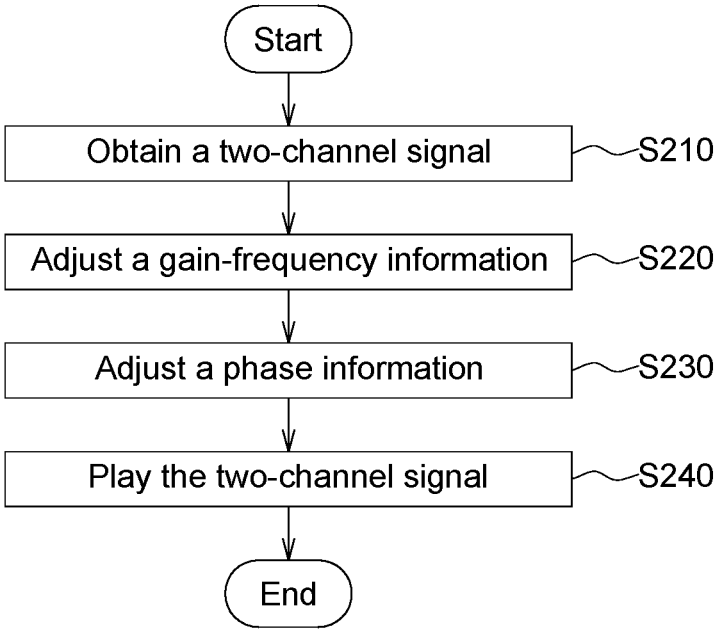
FIG. 2 is a flowchart of a two-channel balance method according to an embodiment.

Referring to FIG. 2, a flowchart of a two-channel balance method according to an embodiment is shown. Firstly, the method begins at step S210, a two-channel signal S0 is obtained. The two-channel signal S0 can be obtained from an optical disc drive or a hard disc or can be downloaded from the Internet.

Next, the method proceeds to step S220, a gain-frequency information of the two-channel signal S0 is adjusted by a gain-frequency adjustment unit 140 to obtain a two-channel signal S1.

Then, the method proceeds to step S230, a phase information of the two-channel signal S1 is adjusted by the phase adjustment unit 190 to obtain a two-channel signal S2.

Then, the method proceeds to step S240, the two-channel signal S2 is played by the left speaker unit 120 and the right speaker unit 130. After gain-frequency adjustment and phase adjustment are performed, the user, when listening to the two-channel signal S2, will not perceive that signal intensities are inconsistent or perceive that the sound field is offset.

Figure 3:
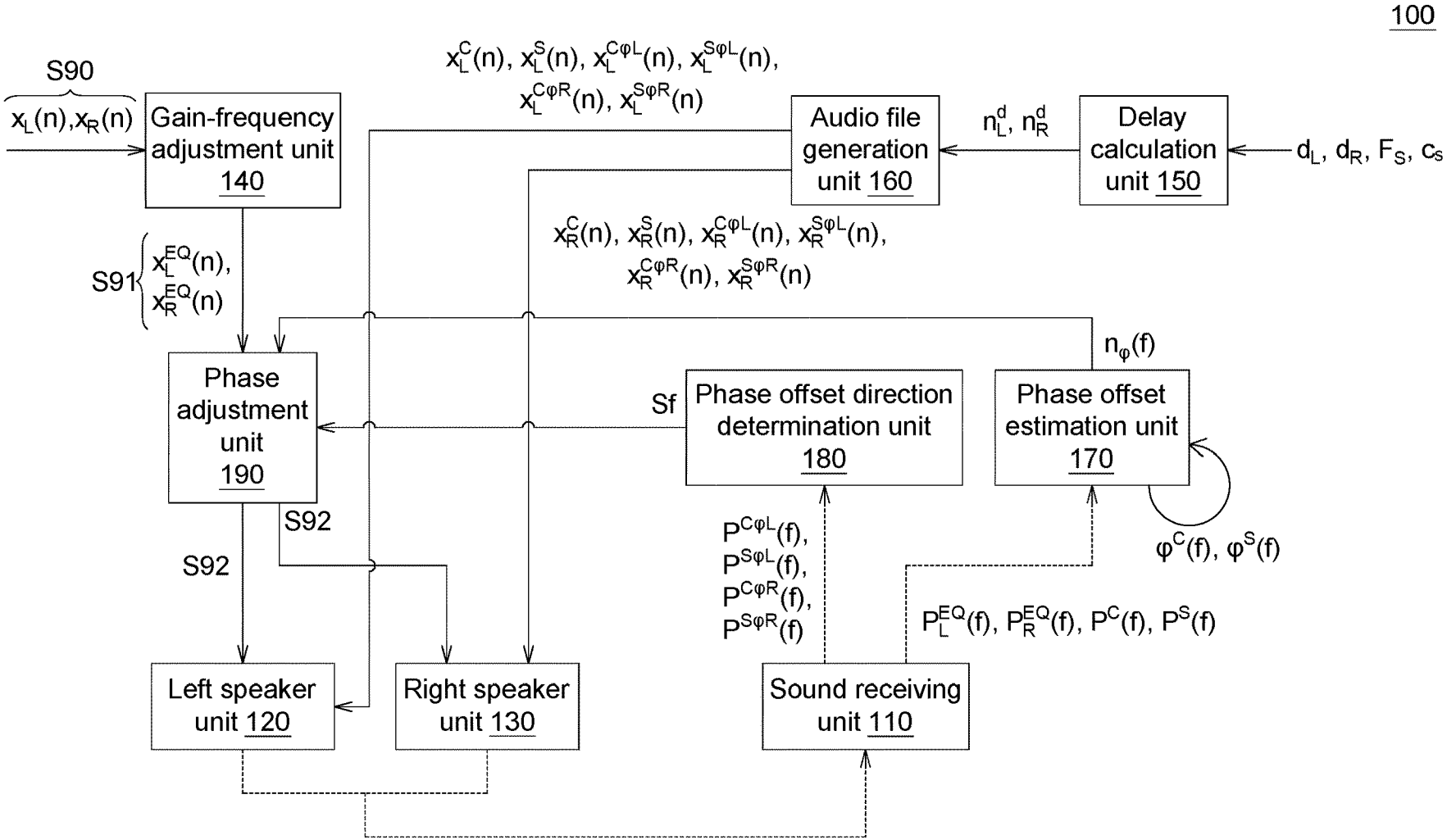
FIG. 3 is a block diagram of the electronic device according to an embodiment.

Referring to FIG. 3, a block diagram of the electronic device 100 according to an embodiment is shown. The electronic device 100 includes a sound receiving unit 110, a left speaker unit 120, a right speaker unit 130, a gain-frequency adjustment unit 140, a delay calculation unit 150, an audio file generation unit 160, a phase offset estimation unit 170, a phase offset direction determination unit 180 and a phase adjustment unit 190. The gain-frequency adjustment unit 140 is configured to perform a gain-frequency adjustment procedure. The phase adjustment unit 190 is configured to perform a phase adjustment procedure. The gain-frequency adjustment unit 140, the delay calculation unit 150, the audio file generation unit 160, the phase offset estimation unit 170, the phase offset direction determination unit 180, the phase adjustment unit 190 can be realized by a circuit, a chip, a circuit board, a programming module or a storage device for storing programming codes. After analyzing suitable phase adjustment parameters using the delay calculation unit 150, the audio file generation unit 160, the phase offset estimation unit 170 and the phase offset direction determination unit 180, the electronic device 100 performs a phase offset procedure for each frequency band to adjust the sound field offset.

In an embodiment, once one electronic device 100 is selected from the same batch for the analysis of phase adjustment parameters, there is no need to perform the analysis of phase adjustment parameters to the remaining electronic devices 100. Therefore, the electronic device 100 can dispense with the delay calculation unit 150, the audio file generation unit 160, the phase offset estimation unit 170 and the phase offset direction determination unit 180. Instead, the gain-frequency adjustment unit 140 directly performs the gain-frequency adjustment procedure, and the phase adjustment unit 190 subsequently performs the phase adjustment procedure. Detailed descriptions of the operation of each element disclosed above are disclosed below with accompanying flowcharts.

Figure 4:
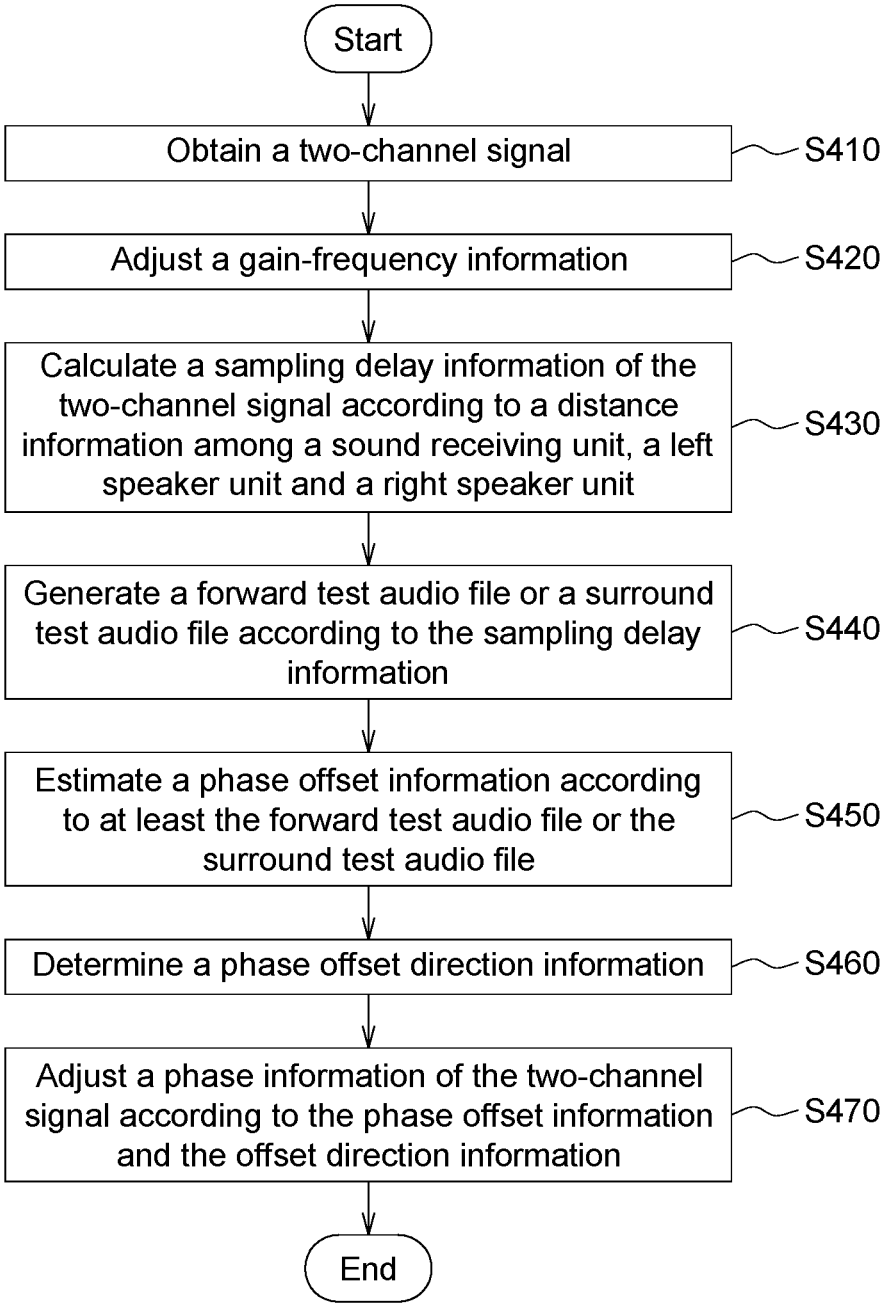
FIG. 4 is a flowchart of a two-channel balance method according to an embodiment.
Figure 5:
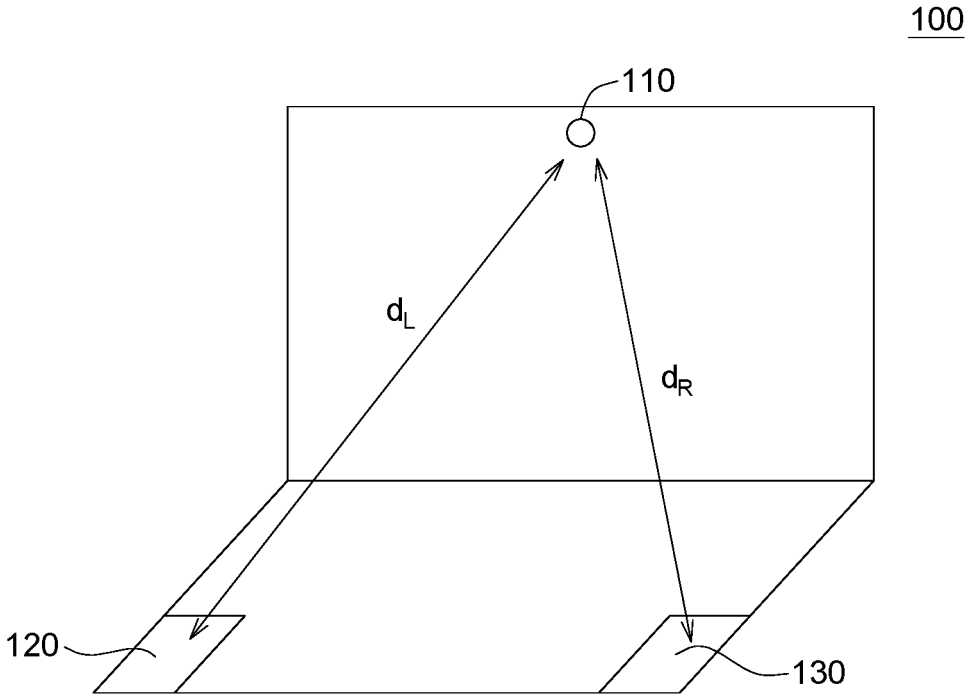
FIGS. 5 to 7 are diagrams of each step of FIG. 4.
Figure 6:
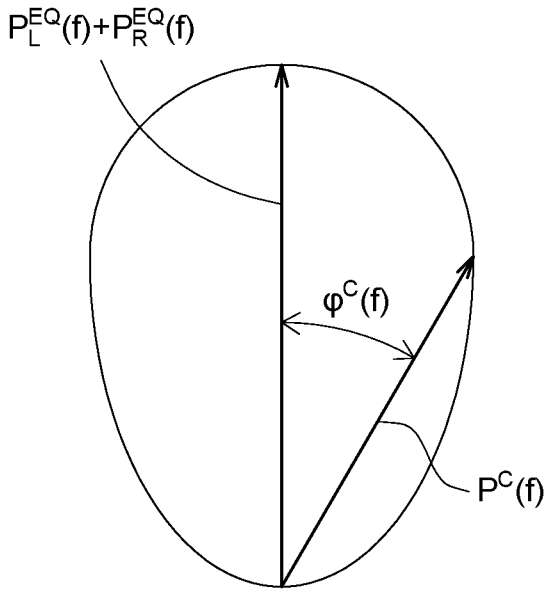
Figure 7:
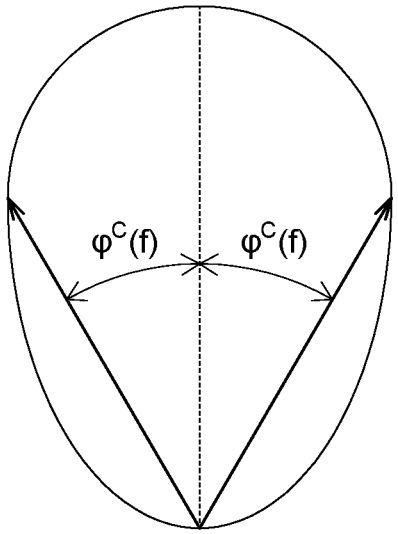

Referring to FIGS. 4 to 7. FIG. 4 is a flowchart of a two-channel balance method according to an embodiment. FIGS. 5 to 7 are diagrams of each step of FIG. 4. Firstly, the method begins at step S410, a left channel signal $X_L(n)$ and a right channel signal $X_R(n)$ identical to the left channel signal $X_L(n)$ (that is, the two-channel signal S90) are obtained according to the pink noises used for measuring the sound field.

Then, the method proceeds to step S420, the gain-frequency information of the left channel signal $X_L(n)$ and the right channel signal $X_R(f)$ (that is, the two-channel signal S90) are adjusted by the gain-frequency adjustment unit 140 to obtain a left channel signal $x_L^{EQ}(n)$ and a right channel signal $x_R^{EQ}(n)$ (that is, the two-channel signal S91). In the present step, when only the left channel signal $x_L^{EQ}(n)$ is played, the sound receiving unit 110 receives a sound pressure amplitude $P_L^{EQ}(f)$ of each frequency band; when only the right channel signal $x_R^{EQ}(n)$ is played, the sound receiving unit 110 receives a sound pressure amplitude $P_R^{EQ}(f)$ of each frequency band.

Then, the method proceeds to step S430, as indicated in FIG. 5, a left channel sampling delay $n_L^d$ and a right channel sampling delay $n_R^d$ of the two-channel signal S91 (that is, the sampling delay information) are calculated by the delay calculation unit 150 according to a first distance $d_L$ between the sound receiving unit 110 and the left speaker unit 120 and a second distance $d_R$ between the sound receiving unit 110 and the right speaker unit 130 (that is, the distance information). If the second distance $d_R$ is greater than or equivalent to the first distance $d_L$, then the right channel sampling delay $n_R^d$ is 0 and the left channel sampling delay $n_L^d$ is expressed as: $(d_R-d_L)\times F_S/c_s$ (a function of the sampling frequency $F_S$, the sound speed $c_s$, the second distance $d_R$, and the first distance $d_L$). If the second distance $d_R$ is smaller than the first distance $d_L$, then the left channel sampling delay $n_L^d$ is 0, and the right channel sampling delay $n_R^d$ is expressed as: $(d_L-d_R)\times F_S/c_s$.

Then, the method proceeds to step S440, a left channel forward test audio file $x_L^C(n)$/a right channel forward test audio file $x_R^C(n)$ (that is, the forward test audio file) or a left channel surround test audio file $x_L^S(n)$/a right channel surround test audio file $x_R^S(n)$ (that is, the surround test audio file) is generated by the audio file generation unit 160 according to the left channel sampling delay n and the right channel sampling delay $n_R^d$ (that is, the sampling delay information).

The left channel surround test audio file $x_L^S(n)$ is expressed as: $x_L(n-n_L^d)$, and the right channel forward test audio file $x_R^C(n)$ is expressed as: $x_R(n-n_R^d)$. When the left channel forward test audio file $x_L^C(n)$ and the right channel forward test audio file $x_R^C(n)$ are played, the sound receiving unit 110 receives a forward sound pressure amplitude $P^C(f)$. The left channel surround test audio file $x_L^S(n)$ is identical to the left channel forward test audio file $x_L^C(n)$, and the right channel surround test audio file $x_R^S(n)$ is opposite to the right channel forward test audio file $x_R^C(n)$. When the left channel surround test audio file $x_L^S(n)$ and the right channel surround test audio file $x_R^S(n)$ are played, the sound receiving unit 110 receives a surround sound pressure amplitude $P^S(f)$.

Then, the method proceeds to step S450, a phase offset $n_\varphi(f)$ (the phase offset information) is estimated by the phase offset estimation unit 170 according to at least the left channel forward test audio file $x_L^C(n)$/the right channel forward test audio file $x_R^C(n)$ (that is, the forward test audio file), or the left channel surround test audio file $x_L^S(n)$/the right channel surround test audio file $x_R^S(n)$.

Ideally, the phase offset is 0. When the left channel forward test audio file $x_L^C(n)$/the right channel forward test audio file $x_R^C(n)$ are played, in theory the signal will overlap at the center point, and the sound pressure amplitude is equivalent to $P_L^{EQ}(f)$ and $P_R^{EQ}(f)$ obtained when the left channel signal $x_L^{EQ}(n)$ and the right channel signal $x_R^{EQ}(n)$ are played respectively. Therefore, the maximum value of the forward sound pressure amplitude $P^C(f)$ is the sum of the sound pressure amplitude $P_L^{EQ}(f)$ and the sound pressure amplitude $P_R^{EQ}(f)$. The closer to the ideal, the smaller the offset, and the larger the forward sound pressure amplitude $P^C(f)$. As indicated in FIG. 6, the forward offset $\varphi^S(f)$ is defined as:

$$\cos^{-1}\left(\frac{P^C(f)}{P_L^{EQ}(f)+P_R^{EQ}(f)}\right).$$

The surround audio and the forward audio are opposite to each other. When the left channel surround test audio file $x_L^S(n)$ and the right channel surround test audio file $x_R^S(n)$ are played, in theory the signal at the center point will be neutralized, the sound pressure amplitude becomes 0, and the surround offset $\varphi^S(f)$ is defined as:

$$\sin^{-1}\left(\frac{P^S(f)}{P_L^{EQ}(f)+P_R^{EQ}(f)}\right).$$

The phase offset $n_\varphi(f)$ represented by sampling delay can be expressed as:

$$\frac{F_S\times\sqrt{\varphi^C(f)\times\varphi^S(f)}}{\pi\times f}.$$

If the respective sound pressure amplitudes of the left channel signal $x_L^{EQ}(n)$ and the right channel signal $x_R^{EQ}(n)$ are not considered, then the phase offset $n_\varphi(f)$ can be expressed as:

$$\frac{F_S\times\tan^{-1}(P^S(f)/P^C(f))}{\pi\times f}.$$

Then, the method proceeds to step S460, a phase offset direction information is determined by the phase offset direction determination unit 180. As indicated in FIG. 7, no matter the offset direction is leftward or rightward, the sound pressure amplitude is the same. In the present step, the forward left offset signals include: the left channel forward left offset testing signal $x_L^{C\varphi L}(n)$ whose value is $x_L^C(n-n_\varphi(f))$ and the right channel forward left offset testing signal $x_R^{C\varphi L}(n)$ whose value is equivalent to right channel forward test audio file $x_R^C(n)$. The forward left offset sound pressure amplitude $P^{C\varphi L}(f)$ is obtained through measurement.

In the present step, the surround left offset signals include: the left channel surround left offset testing signal $x_L^{S\varphi L}(n)$ whose value is equivalent to $x_L^{C\varphi L}(n)$ and the right channel surround left offset testing signal $x_R^{S\varphi L}(n)$ whose value is the backward right channel forward left offset testing signal $x_R^{C\varphi L}(n)$. The surround left offset sound pressure amplitude $P^{S\varphi L}(f)$ is obtained through measurement.

In the present step, the forward right offset signals include: the left channel forward right offset testing signal $x_L^{C\varphi R}(n)$ whose value is left channel forward test audio file $x_L^C(n)$ and the right channel forward right offset testing signal $x_R^{C\varphi R}(n)$ whose value is $x_R^C(n-n_\varphi(f))$. The forward right offset sound pressure amplitude $P^{C\varphi R}(f)$ is obtained through measurement.

In the present step, the surround right offset signals include: the left channel surround right offset testing signal $x_L^{S\varphi R}(n)$ whose value is the left channel forward right offset testing signal $x_L^{C\varphi R}(n)$ and the right channel surround right offset testing signal $x_R^{S\varphi R}(n)$ whose value is the backward right channel surround right offset testing signal $x_R^{C\varphi R}(n)$. The surround right offset sound pressure amplitude $P^{S\varphi R}(f)$ is obtained through measurement.

Lastly, the ratio $$\frac{P^{S\varphi L}(f)}{P^{C\varphi L}(f)}$$

of the surround left offset sound pressure amplitude to the forward left offset sound pressure amplitude is compared with the ratio $$\frac{P^{S\varphi R}(f)}{P^{C\varphi R}(f)}$$

of the surround right offset sound pressure amplitude to the forward right offset sound pressure amplitude, and the side with the smaller ratio is selected as the offset direction Sf of the present frequency band.

Then, the method proceeds to step S470, a phase information of the left channel signal $x_L^{EQ}(n)$ and the right channel signal $x_R^{EQ}(n)$ (that is, the two-channel signal S91) is adjusted by the phase adjustment unit 190 according to the phase offset $n_\varphi(f)$ and the offset direction Sf. In the present step, for each frequency band, a set of new filters corresponding to the left channel and the right channel is formed according to the phase offset $n_\varphi(f)$ and the selection of the phase offset direction Sf (the left offset or the right offset) and the previous gain-frequency adjustment, and the set of new filters is further provided to the left channel signal $x_L^{EQ}(n)$ and the right channel signal $X_R^{EQ}(n)$ (that is, the two-channel signal S91) to obtain a new two-channel signal S92.

Refer to Table 1, which shows the experiment results of the energy distribution of the pink noises at the center point 0° and at 30° to both sides of the center point. The energy distribution of the pink noises is measured using A-weighting which is near to the perception of human ears. As indicated in Table 1, the volume of the original pink noises at the left is louder than that at the right by 2.4 dB, and after correction, the difference is reduced to 1 dB only.

TABLE 1

| | 30° to the left | 0° | 30° to the right |
|---|---|---|---|
| Original pink noises | 76.5 dB | 79.4 dB | 74.1 dB |
| Corrected pink noises | 76.0 dB | 80.1 dB | 77.0 dB |

While the invention has been described by way of example and in terms of the preferred embodiment(s), it is to be understood that the invention is not limited thereto. On the contrary, it is intended to cover various modifications and similar arrangements and procedures and the scope of the appended claims therefore should be accorded the broadest interpretation so as to encompass all such modifications and similar arrangements and procedures.

What is claimed is:

1. A two-channel balance method with phase offset correction, comprising:

adjusting a gain-frequency information of a two-channel signal;

calculating a sampling delay information of the two-channel signal according to a distance information among a sound receiving unit, a left speaker unit and a right speaker unit;

generating a forward test audio file or a surround test audio file according to the sampling delay information;

estimating a phase offset information according to at least the forward test audio file or the surround test audio file;

determining a phase offset direction information; and adjusting a phase information of the two-channel signal according to the phase offset information and the phase offset direction information.

2. The two-channel balance method with phase offset correction according to claim 1, wherein in the step of calculating the sampling delay information of the two-channel signal, the sound receiving unit and the left speaker unit are separated by a first distance, the sound receiving unit and the right speaker unit are separated by a second distance, and the sampling delay information is relevant to a difference between the first distance and the second distance.

3. The two-channel balance method with phase offset correction according to claim 1, wherein in the step of generating the forward test audio file or the surround test audio file, a forward sound pressure amplitude information of the forward test audio file or a surround sound pressure amplitude information of the surround test audio file is calculated.

4. The two-channel balance method with phase offset correction according to claim 1, wherein in the step of estimating the phase offset information, the phase offset information is estimated according to both of the forward test audio file and the surround test audio file.

5. The two-channel balance method with phase offset correction according to claim 1, wherein in the step of determining the phase offset direction information, a forward left offset test audio file, a surround left offset test audio file, a forward right offset test audio file and a surround right offset test audio file are played, and the phase offset direction information is determined according to a forward left offset sound pressure amplitude information of the forward left offset test audio file, a surround left offset sound pressure amplitude information of the surround left offset test audio file, a forward right offset sound pressure amplitude information of the forward right offset test audio file and a surround right offset sound pressure amplitude information of the surround right offset test audio file.

6. The two-channel balance method with phase offset correction according to claim 1, wherein the two-channel signal includes a left channel signal and a right channel signal identical to the left channel signal.

7. The two-channel balance method with phase offset correction according to claim 6, wherein in the step of adjusting the gain-frequency information of the two-channel signal, when only the left channel signal is played, a sound pressure amplitude of each frequency band is received; when only the right channel signal is played, the sound pressure amplitude of each frequency band is received.

8. The two-channel balance method with phase offset correction according to claim 7, wherein in the step of calculating the sampling delay information, a first distance is formed between the sound receiving unit and the left speaker unit, if a second distance between the between the sound receiving unit and the right speaker unit is greater than or equivalent to the first distance between the sound receiving unit and the left speaker unit, then a right channel sampling delay is 0 and a left channel sampling delay is expressed as: $(d_R-d_L)\times F_S/c_s$, $F_s$ is a function of a sampling frequency, $c_s$ is a sound speed, $d_R$ is the second distance $d_R$, and $d_L$ is the first distance.

9. The two-channel balance method with phase offset correction according to claim 8, wherein in the step of calculating the sampling delay information, if the second distance is smaller than the first distance, then the left channel sampling delay is 0, and the right channel sampling delay is expressed as: $(d_L-d_R)\times F_S/c_s$.

10. An electronic device, comprising:

a sound receiving unit;

a left speaker unit;

a right speaker unit;

a gain-frequency adjustment unit configured to adjust a gain-frequency information of a two-channel signal;

a delay calculation unit configured to calculate a sampling delay information of the two-channel signal according to a distance information among the sound receiving unit, the left speaker unit and the right speaker unit;

an audio file generation unit configured to generate a forward test audio file or a surround test audio file according to the sampling delay information;

a phase offset estimation unit configured to estimate a phase offset information according to at least the forward test audio file or the surround test audio file;

a phase offset direction determination unit configured to determine a phase offset direction information; and a phase adjustment unit configured to adjust a phase information of the two-channel signal according to the phase offset information and the phase offset direction information.

11. The electronic device according to claim 10, wherein the sound receiving unit and the left speaker unit are separated by a first distance, the sound receiving unit and the right speaker unit are separated by a second distance, and the sampling delay information is relevant to a difference between the first distance and the second distance.

12. The electronic device according to claim 10, wherein the audio file generation unit further calculates a forward sound pressure amplitude information of the forward test audio file or a surround sound pressure amplitude information of the surround test audio file.

13. The electronic device according to claim 10, wherein the phase offset estimation unit estimates the phase offset information according to both of the forward test audio file and the surround test audio file.

14. The electronic device according to claim 10, wherein the phase offset direction determination unit plays a forward left offset test audio file, a surround left offset test audio file, a forward right offset test audio file and a surround right offset test audio file, and determines the phase offset direction information according to a forward left offset sound pressure amplitude information of the forward left offset test audio file, a surround left offset sound pressure amplitude information of the surround left offset test audio file, a forward right offset sound pressure amplitude information of the forward right offset test audio file and a surround right offset sound pressure amplitude information of the surround right offset test audio file.

15. The electronic device according to claim 10, wherein the two-channel signal includes a left channel signal and a right channel signal identical to the left channel signal.

16. The electronic device according to claim 15, wherein when only the left channel signal is played, the sound receiving unit receives a sound pressure amplitude of each frequency band; when only the right channel signal is played, the sound receiving unit receives the sound pressure amplitude of each frequency band.

17. The electronic device according to claim 16, wherein a first distance is formed between the sound receiving unit and the left speaker unit, if a second distance between the between the sound receiving unit and the right speaker unit is greater than or equivalent to the first distance between the sound receiving unit and the left speaker unit, then a right channel sampling delay is 0 and a left channel sampling delay is expressed as: $(d_R-d_L)\times F_S/c_s$, $F_s$ is a function of a sampling frequency, $c_s$ is a sound speed, $d_R$ is the second distance $d_R$, and $d_L$ is the first distance.

18. The electronic device according to claim 17, wherein if the second distance is smaller than the first distance, then the left channel sampling delay is 0, and the right channel sampling delay is expressed as: $(d_L-d_R)\times F_S/c_s$.

19. An electronic device, comprising:

a gain-frequency adjustment unit configured to adjust a gain-frequency information of a two-channel signal;

a phase offset direction determination unit configured to determine a phase offset direction information;

a phase adjustment unit configured to adjust a phase information of the two-channel signal according to a phase offset information and the phase offset direction information;

a left speaker unit; and a right speaker unit, wherein the left speaker unit and the right speaker unit are configured to play the two-channel signal which is adjusted, wherein the phase offset direction determination unit plays a forward left offset test audio file, a surround left offset test audio file, a forward right offset test audio file and a surround right offset test audio file, and determines the phase offset direction information according to a forward left offset sound pressure amplitude information of the forward left offset test audio file, a surround left offset sound pressure amplitude information of the surround left offset test audio file, a forward right offset sound pressure amplitude information of the forward right offset test audio file and a surround right offset sound pressure amplitude information of the surround right offset test audio file.

20. The electronic device according to claim 19, wherein the two-channel signal includes a left channel signal and a right channel signal identical to the left channel signal.

* * * * *